US005816985A

United States Patent [19]

Ho

[11] Patent Number: 5,816,985

[45] Date of Patent: Oct. 6, 1998

[54] MULTIPURPOSE STRETCHING AND SPORTING EQUIPMENT

[76] Inventor: Sung-Chao Ho, P.O. Box 24-108, Taipei, Taiwan

[21] Appl. No.: 826,998

[22] Filed: May 14, 1997

[51] Int. Cl.[6] ..... A63B 21/02

[52] U.S. Cl. ..... 482/140; 482/125; 482/126

[58] Field of Search ..... 482/121–130, 482/139, 907

[56] References Cited

U.S. PATENT DOCUMENTS

| | | | |
|---|---|---|---|
| 5,137,503 | 8/1992 | Yeh | 482/125 |
| 5,190,512 | 3/1993 | Curran | 482/125 |
| 5,569,135 | 10/1996 | Chen | 482/125 |
| 5,653,665 | 8/1997 | Neeley | 482/125 |
| 5,674,163 | 10/1997 | Sennet | 482/125 |

*Primary Examiner*—Jerome Donnelly
*Attorney, Agent, or Firm*—Bacon & Thomas

[57] ABSTRACT

A multipurpose stretching and sporting equipment, comprising an upper traverse rod, a lower traverse rod and an elastic straps is provided. The upper traverse rod is provided with a neck pillow having a pair of free rotating handles disposed at both sides respectively. A pair of pedals are connected at side portion of said handles. The lower traverse rod is provided with an abdomen pad having a soft pad thereon. The upper and lower traverse rods are connected together by means of the elastic straps which are removably attached to the ends of said upper and lower traverse rods.

In use, the user may step on one traverse rod while holds on the handles or rest his/her neck on the neck pillow while holds on the handles to conduct the movement. The user may also conduct the exercise or movement while he/she stands or sits up. With these movement, the muscles on upper limbs can be suitably strengthened. Furthermore, the user may rest the abdomen pad onto his/her abdomen and conduct a lifting movement with his/her abdomen while holds on the handles. With these provision, the muscles can be suitably strengthened. The equipment features a compact and simple configuration which can be readily unfolded for use and folded for exercising. All the families may afford this equipment.

5 Claims, 11 Drawing Sheets

MULTIPURPOSE STRETCHING AND SPORTING EQUIPMENT

FIELD OF THE INVENTION

The present invention relates to a stretching equipment, more particularly, to a multipurpose stretching and sporting equipment wherein the limbs can be suitably stretched and exercised during the stretching and retracting cycle such that the muscle of the user can be readily trained. This equipment can be readily unfolded for operation as well as folded for storage. This equipment also features a compact configuration.

DESCRIPTION OF PRIOR ART

Health is vital to modern people and continuous sporting is the key to get a good health. A variety of sporting equipment have been introduced into the market which is suitable for disposing indoors for sporting. However, these conventional sporting equipment is bulky, heavy and costly which is not affordable for a family both on budget as well as space. Even the family can afford a space for it, the sporting equipment is hard to move as it is heavy and to store in a convenient way as it is quite heavy. On the other hand, injuries may also be encountered during the handling of this sporting equipment. Furthermore, it is also hard to unpack it for reuse. With the above described defects, a family is hard to afford this kind of sporting equipment.

In order to provide a sporting environment, many a sporting club have been established wherein many a sporting equipment and/or facilities have been installed for member to use since a family can not afford this sporting equipment. However, the registering fee for these clubs are again not affordable for a family.

Even people can make a simple stretching and retracting movement with his/her limbs, without the working load, the result can not reach a satisfactory level. In light of this, there is still a room for providing a sporting equipment which is compact and affordable for a family.

SUMMARY OF THE INVENTION

It is the objective of this invention to provide a multipurpose stretching and sporting equipment, comprises an upper traverse rod, a lower traverse rod and an elastic straps. The upper traverse rod is provided with a neck pillow having a pair of free rotating handles disposed at both sides respectively. A pair of pedals are connected at side portion of said handles. The lower traverse rod is provided with an abdomen pad having a soft pad thereon. The upper and lower traverse rods are connected together by means of the elastic straps which are removably attached to the ends of said upper and lower traverse rods. In use, the user may step on one traverse rod while holds on the handles or rest his/her neck on the neck pillow while holds on the handles to conduct the movement. The user may also conduct the exercise or movement while he/she stands or sits up. With these movement, the muscles on upper limbs can be suitably strengthened. Furthermore, the user may rest the abdomen pad onto his/her abdomen and conduct a lifting movement with his/her abdomen while holds on the handles. With these provision, the muscles can be suitably strengthened.

It is the objective of this invention to provide a multipurpose stretching and sporting equipment wherein the equipment features a compact configuration which can be readily unfolded during use and folded for storage when not in use.

BRIEF DESCRIPTION OF THE DRAWINGS

In order that the present invention may more readily be understood the following description is given, merely by way of example with reference to the accompanying drawings, in which.

BRIEF DESCRIPTION OF NUMERALS

Figure 1:
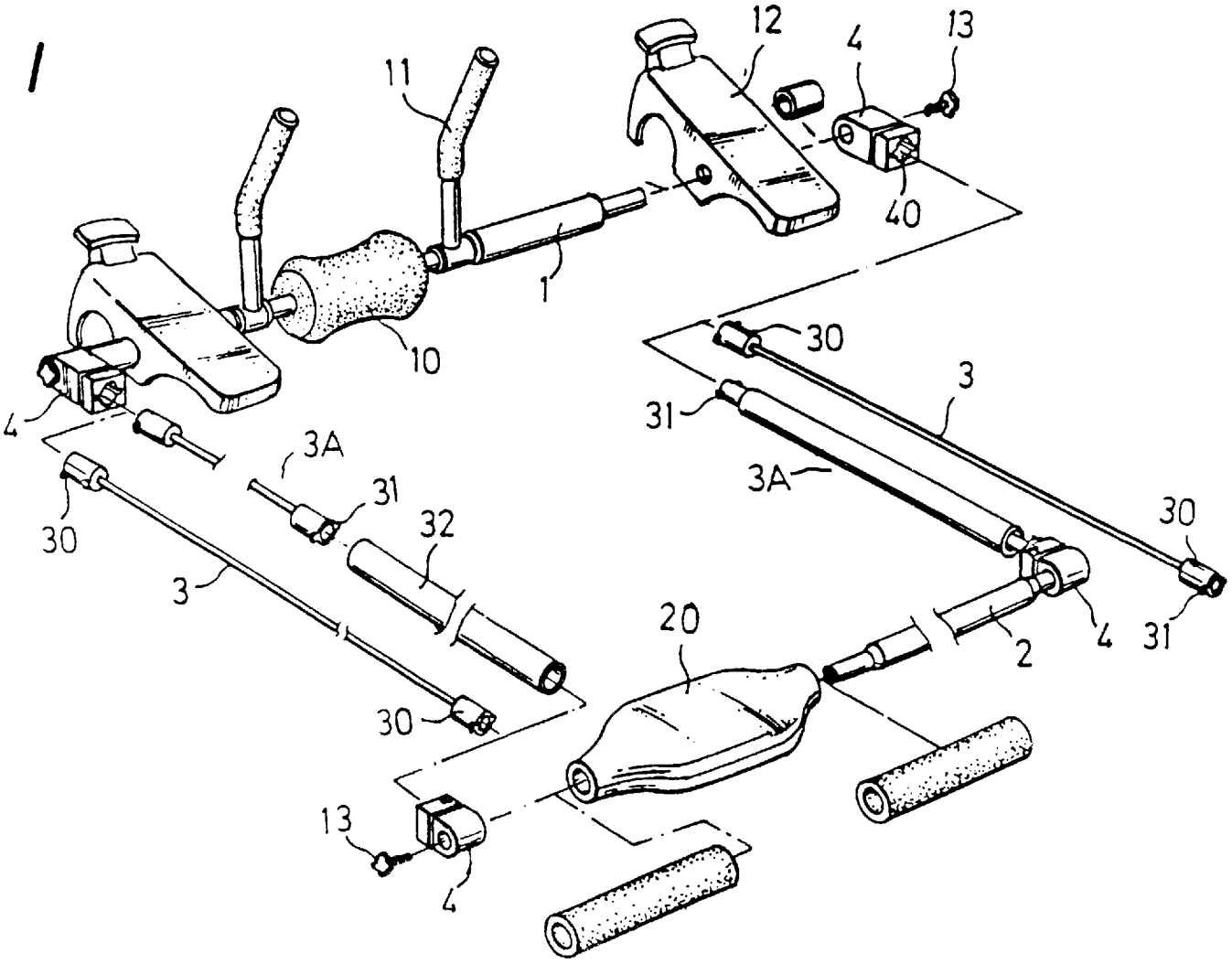
FIG. 1 is an exploded perspective view of the stretching and sporting equipment made according to the present invention.

| | | | |
|---|---|---|---|
| 1 | upper traverse rod | 2 | lower traverse rod |
| 3, 3A | elastic strap or spring | 4 | socket |
| 5 | spring | 10 | neck pillow |
| 11 | handle | 12 | pedal |
| 13 | locking bolt | 20 | abdomen pad |
| 30 | fastener | 31 | projection |
| 32 | tube | 40 | retaining hole |

DETAILED DESCRIPTION OF PREFERRED EMBODIMENTS

Referring to Figures, the stretching and sporting equipment generally comprises an upper traverse rod 1, a lower traverse rod 2, and a pair of elastic straps 3. The tipper traverse rod 1 is provided with a neck pillow 10 having a circular contour. The neck pillow 10 further includes a pair of handles 11 disposed at both sides respectively. The handles 11 are free to rotate. By means of a locking bolt 13, a fastener 30, a pair of pedals 12 can be readily assembled at both sides of the handles 11 respectively.

Figure 4:
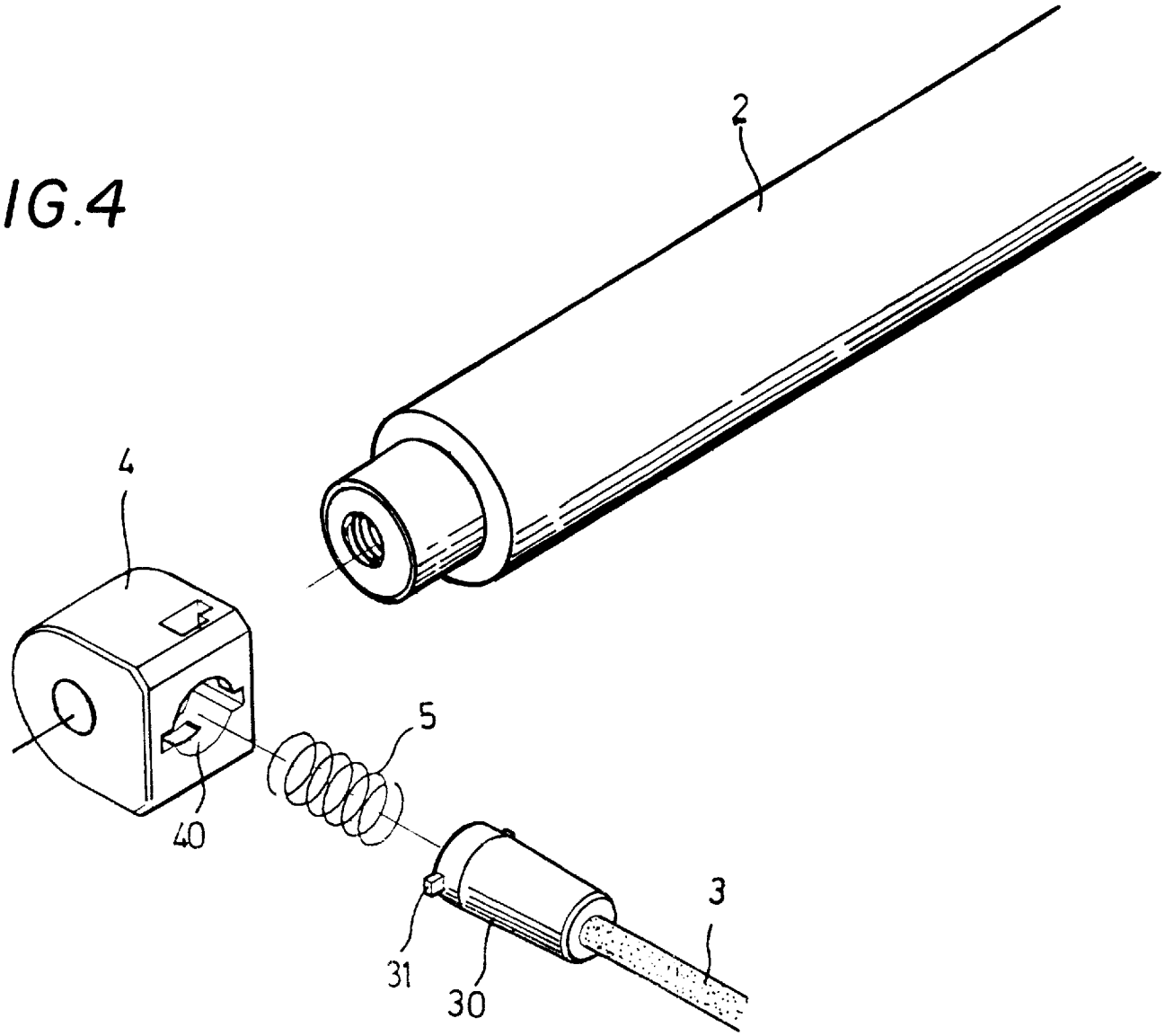
FIG. 4 is an exploded perspective view of the connecting mechanism for elastic strap.
Figure 5:
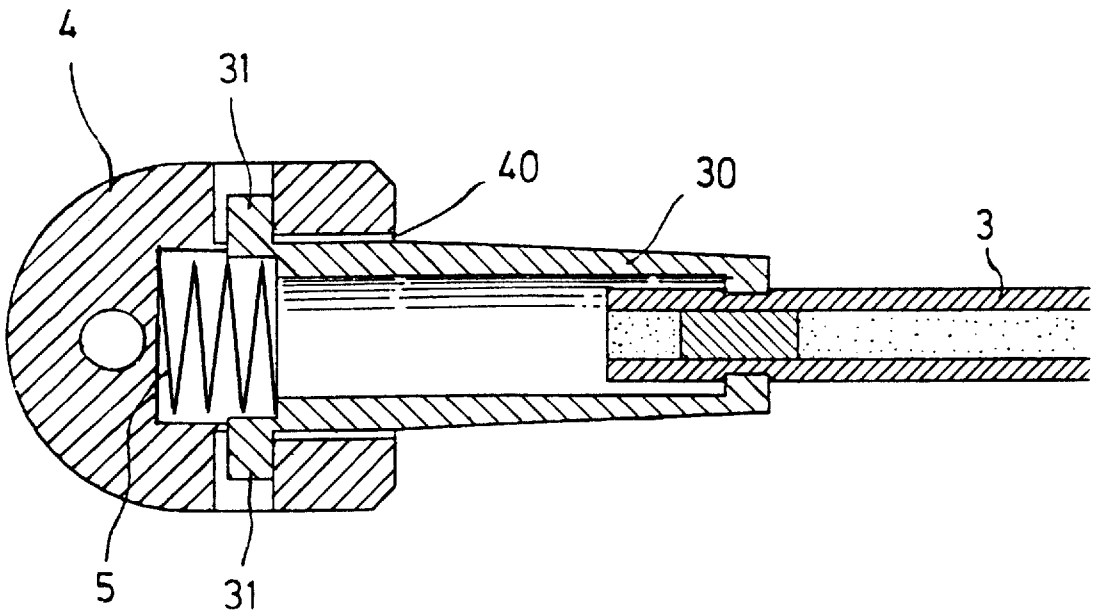
FIG. 5 is a cross sectional view of the elastic strap.

The lower traverse rod 2 is provided with an abdomen pad 20 in the middle portion. The upper and lower traverse rods 1 and 2 are connected by means of a pair of elastic straps 3, 3A, as clearly shown in FIGS. 4 and 5.

Figure 2:
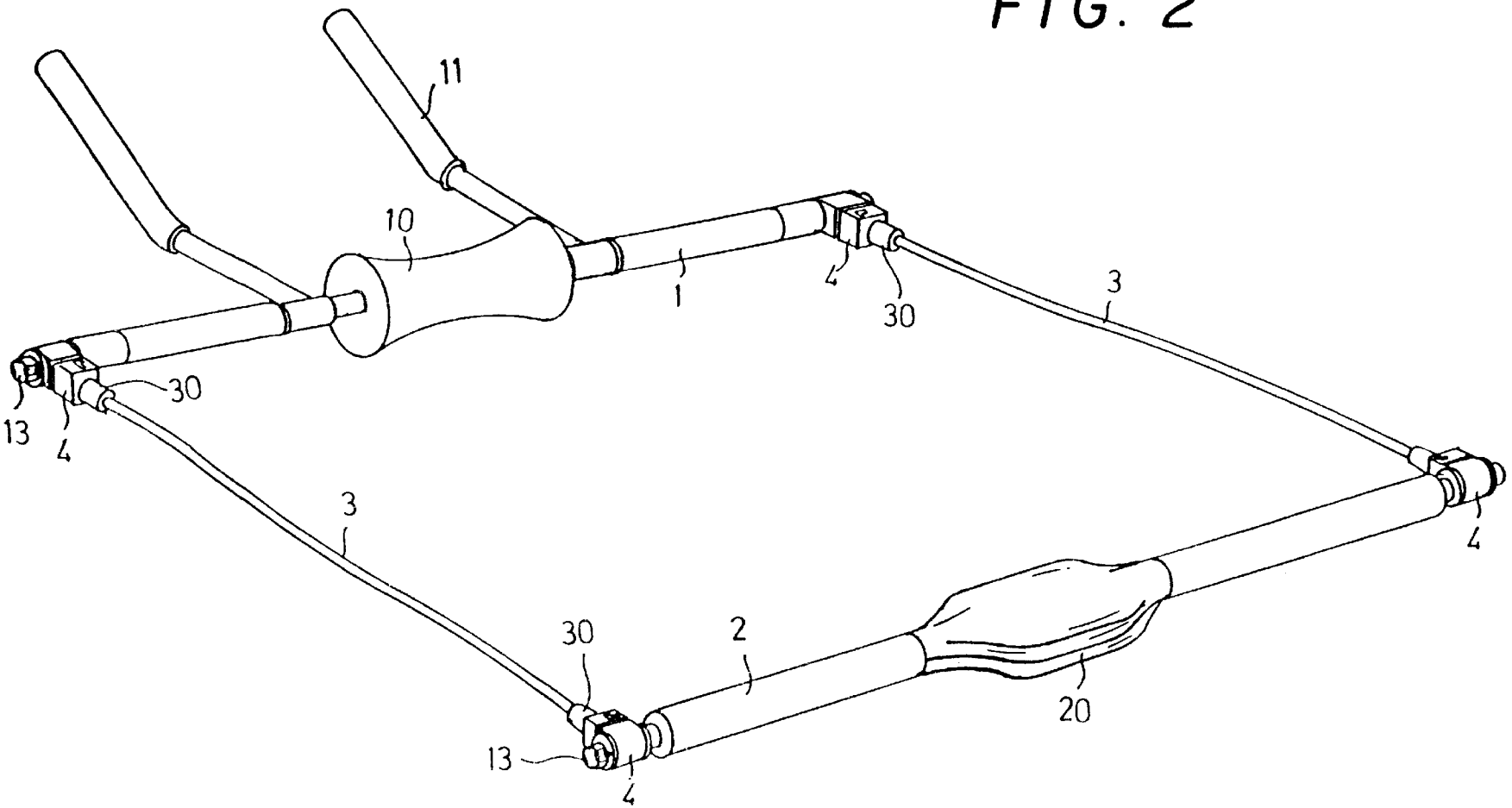
FIG. 2 is a perspective view of the equipment shown in FIG. 1.
Figure 3:
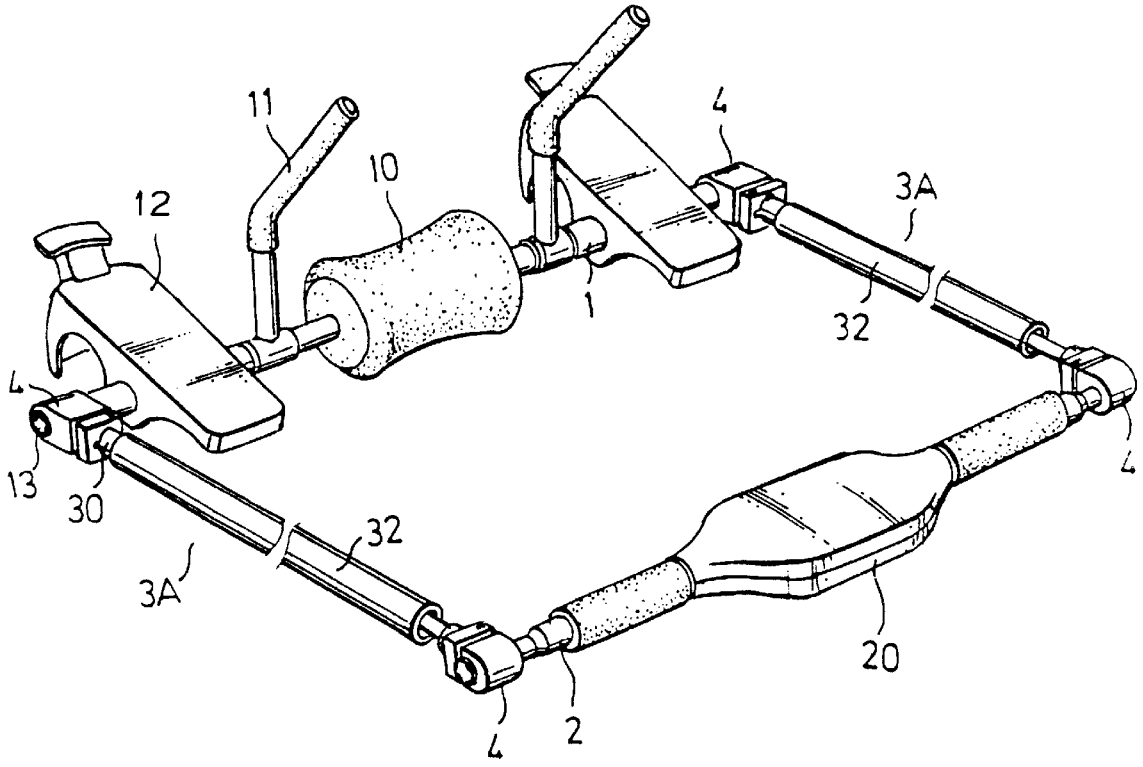
FIG. 3 is still a perspective of a second embodiment of the stretching and sporting equipment made according to the present invention.

The end portion of the upper traverse rod is provided with a socket 4 by means of a locking bolt 13. Accordingly, the fastener 30 disposed at end of the elastic straps 3, 3A can be attached thereof by means of the engagement between a projection 31 and retaining hole 40. The projection 31 can be rotated such that the projection 31 can be stopped by the retaining hole 40 and biased by the spring 5. Consequently, the projection 31 is fixed thereon. If the elastic straps 3, 3A are to remove, the user may simply reverse the assembling procedures. Then a new elastic straps 3, 3A having different length and/or elasticity can be assembled to meet different requirements from different user. Even the connection between the upper traverse rod 1 and the elastic straps 3, 3A is by means of the projection 31 and the retaining hole 40, it can be readily recognized that other type of fastening device can be applied and this is known to the skilled in the art, such as the hooker and locking blot. Accordingly, no detailed description is given below. However, the elastic straps or spring 3, 3A may also attached with a tube 32 such that the fastener 30 can be firmly engaged with the tube 32, as shown in FIG. 2. In this case, one end of the elastic straps 3, 3A are fixed to the tube 32 and the other end can be pulled out.

In operation, the user may simply select a suitable elastic straps 3, 3A having suitable length wherein the user may conduct an exercise in standing, sitting or lying postures. The user may hold on the handles 11 or rest his/her neck on the neck pillow 10 while holds on the handles 11. Then he/she may step on the lower traverse rod 2 or rest on the abdomen pad 20 to conduct a stretching and retracting movement with his/her upper limbs. Accordingly, the muscles on his/her tipper limbs can be strengthened.

Figure 6:
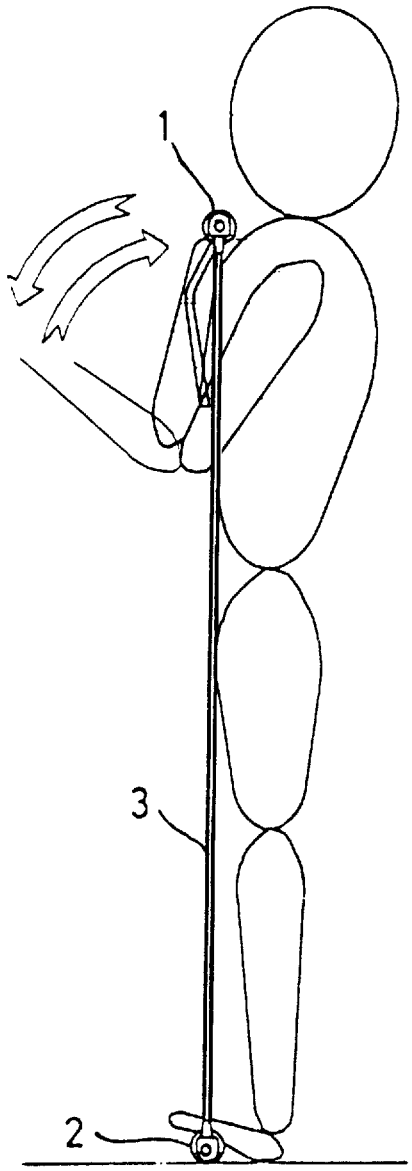
FIG. 6 is a schematic illustration of the stretching and sporting equipment is in use and the user is in standing posture.

As shown in FIG. 6, the user conducts a movement in standing posture.

Figure 7:
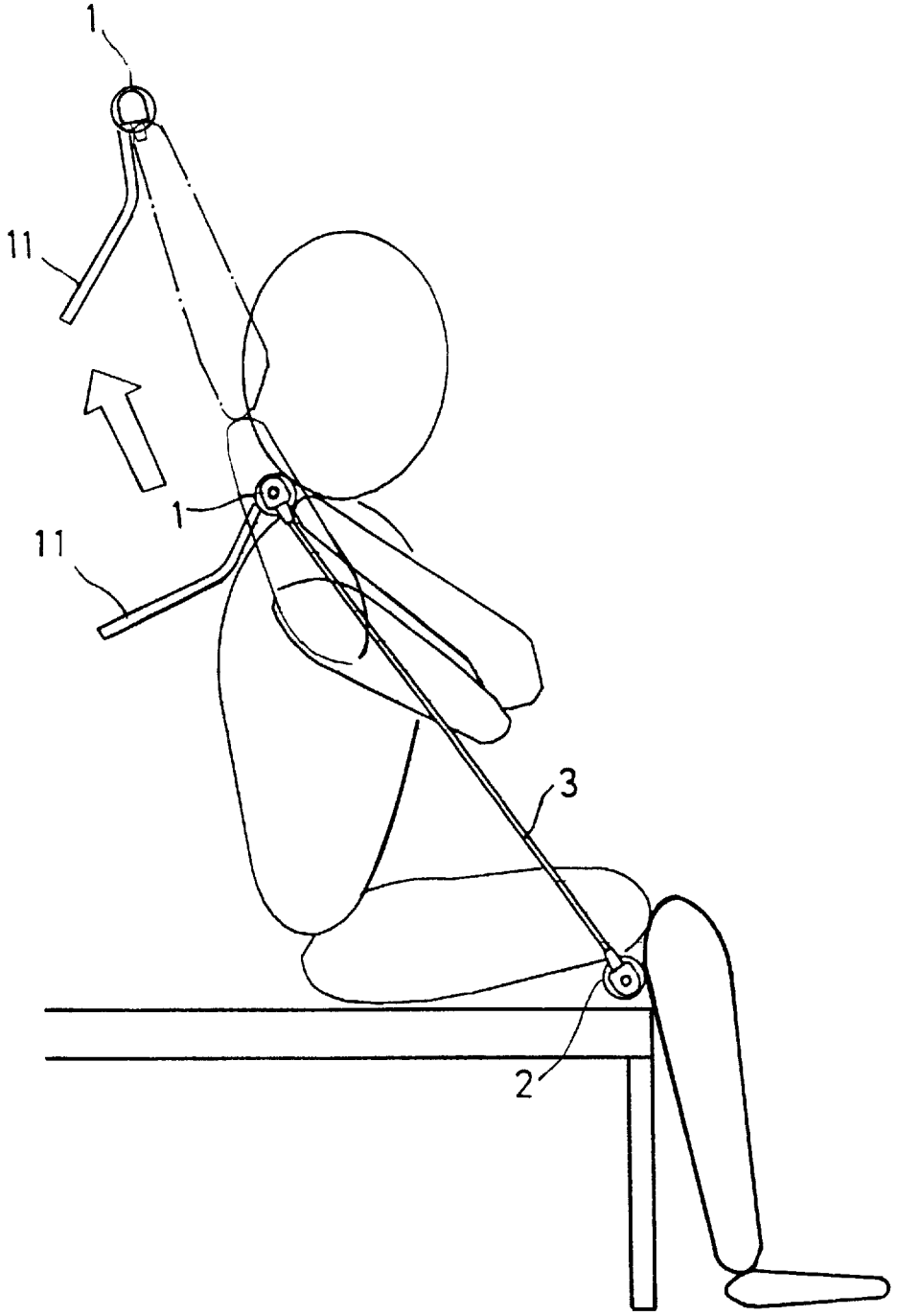
FIG. 7 is still a schematic illustration of the stretching and sporting equipment is in use and the user is in sitting posture.

FIG. 7 shows a user conducts a movement in sitting posture.

Figure 8:
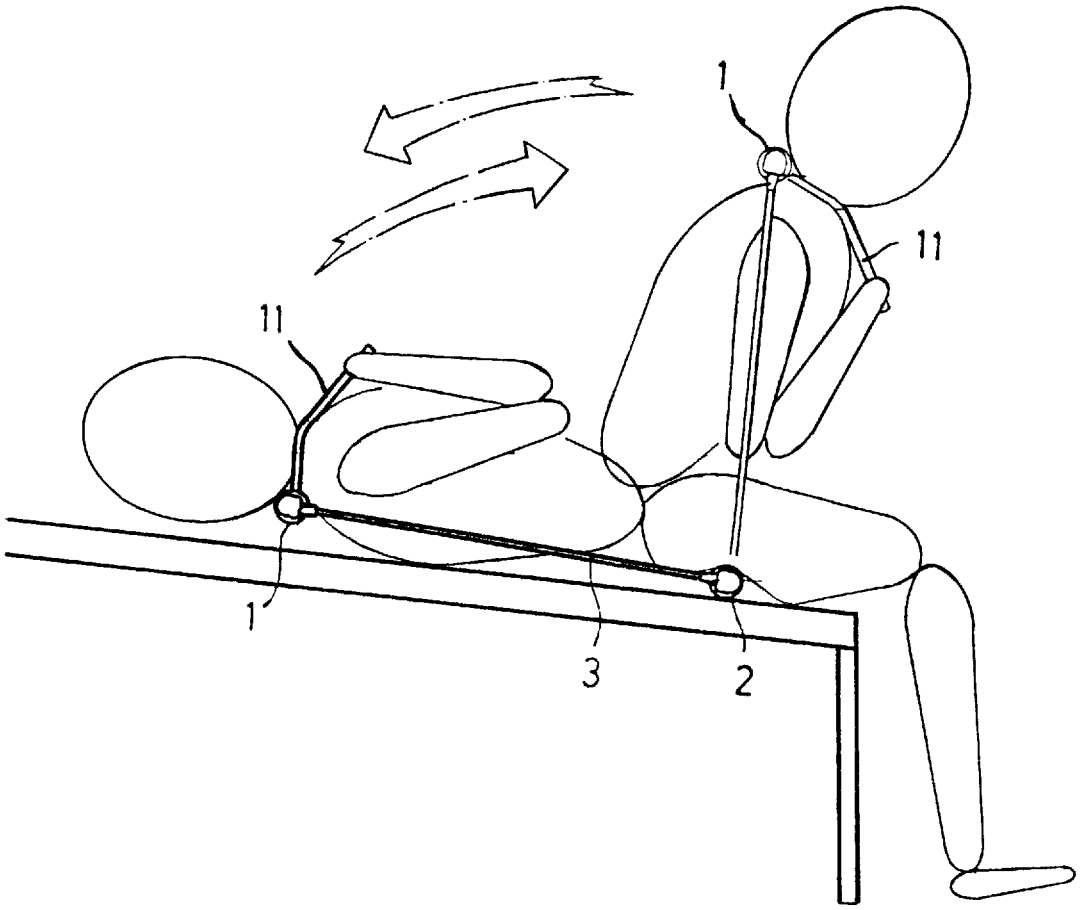
FIG. 8 is similar to FIG. 7 and the stretching and sporting equipment is in use and the user is in another sitting posture.

FIG. 8 still shows a user conducts a movement in sitting posture.

Figure 9:
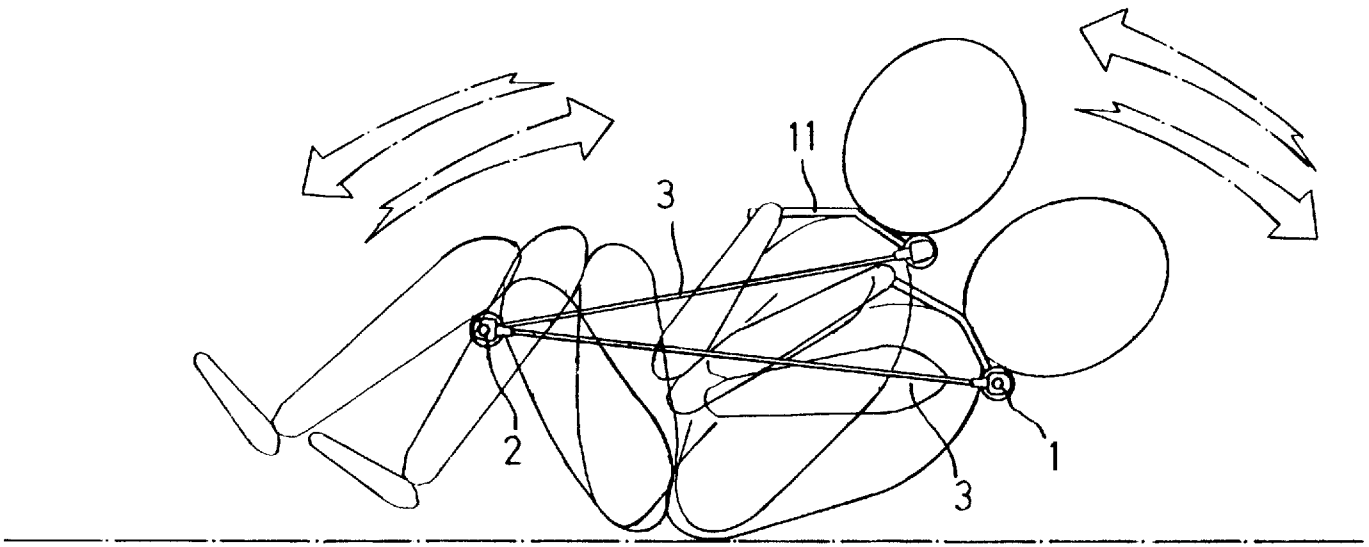
FIG. 9 is a schematic illustration of the stretching and sporting equipment wherein the user is lying down.
Figure 10:
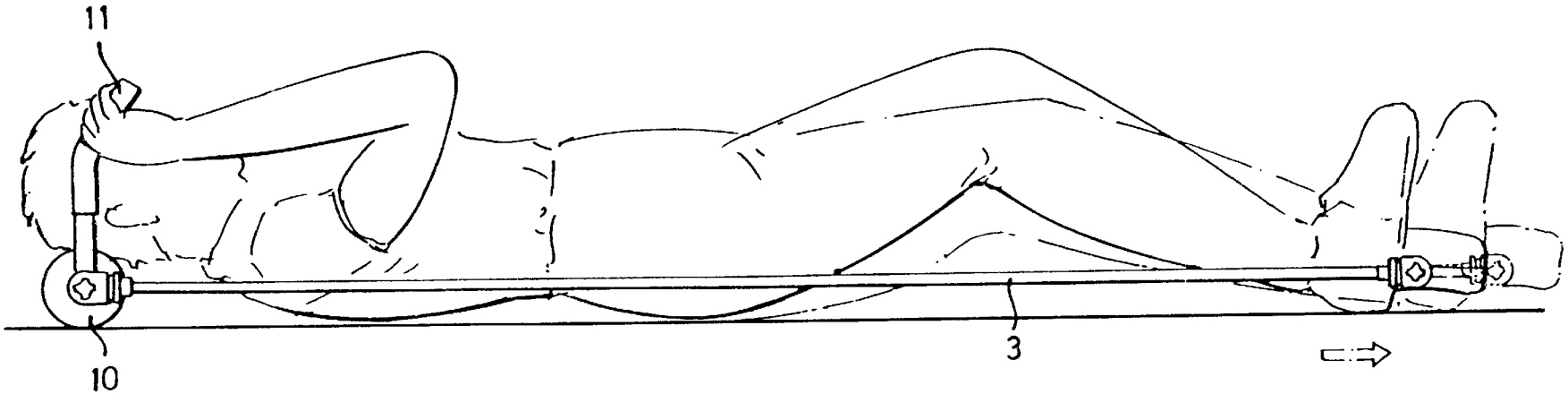
FIG. 10 is similar to FIG. 9 wherein the user is lying down in another posture.

FIGS. 9 and 10 show a user conducts a movement in lying postures. However, there are a plurality of ways for conducting the movement depend on the user, accordingly, no detailed description is given.

If the elasticity of the elastic strap 3, 3A are too tight or loose to conduct a movement, it can be readily and simply replaced with a new elastic straps 3, 3A to meet the requirements from the user.

Figure 11:
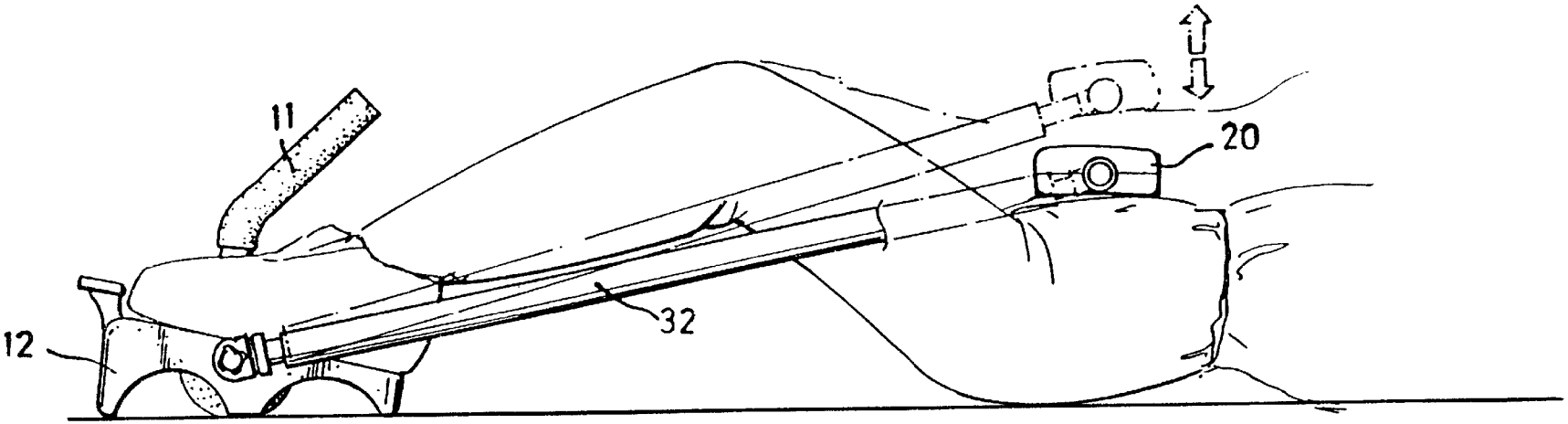
FIG. 11 is a schematic illustration wherein the stretching and sporting equipment may serve as a weightlifting equipment.

Furthermore, if a pair of pedals 12 are assembled, the user may conduct a movement shown in FIG. 11. In this case, the user may step onto the pedals 12 and rest the abdomen pad 20 onto this abdomen portion while holds on the lower traverse rod 2 and conduct a lifting movement with his/her abdomen. With this movement, the hip and/or abdomen portions can be readily styled.

From the forgoing description, the stretching and sporting equipment made according to present invention features a simple and compact configuration which can be readily adapted for different exercises or movements. On the other hand, when the exercise or movement is completed, the elastic straps 3, 3A can be readily dismounted and after that, the upper and lower traverse rods 1 and 2 can be disposed side by side for storage. Apparently, the space required are comparatively small. In light of this, no injuries or accident can be encountered. As it can be readily appreciated, the elastic strap can be readily mounted again for exercise or movement.

While particular embodiment of the present invention has been illustrated and described, it would be obvious to those skilled in the art that various other changes and modifications can be made without departing from the spirit and scope of the invention. It is therefore intended to cover in the appended claims all such changes and modifications that are within the scope of the present invention.

I claim:

1. A multipurpose stretching and exercise device comprising:

a) an upper traverse rod having thereon a neck pillow, handles rotatably connected to the upper traverse rod on opposite sides of the neck pillow and a foot pedal connected to the upper traverse rod adjacent to each handle;

b) a lower traverse rod having thereon a soft pad to engage the abdomen of a user; and c) at least one elastic strap connecting the upper traverse rod and the lower traverse rod.

2. The multipurpose stretching and exercise device of claim 1 wherein the at least one elastic strap is removably connected to at least one of the upper and lower traverse rod.

3. The multipurpose stretching and exercise device of claim 1 comprising a plurality of elastic straps connecting the upper and lower traverse rods.

4. The multipurpose stretching and exercise device of claim 3 wherein the plurality of elastic straps are removably connected to at least one of the upper and lower traverse rods.

5. The multipurpose stretching and exercise device of claim 1 further comprising a tube at least partially enclosing the at least one elastic strap.

* * * * *